US010245830B2

(12) United States Patent
Korthuis et al.

(10) Patent No.: US 10,245,830 B2
(45) Date of Patent: Apr. 2, 2019

(54) PRINTING SYSTEM WITH A FLUID CIRCULATING ELEMENT

(71) Applicant: HEWLETT-PACKARD DEVELOPMENT COMPANY, L.P., Houston, TX (US)

(72) Inventors: Vincent C. Korthuis, Corvallis, OR (US); Eric T. Martin, Corvallis, OR (US); Michael W. Cumbie, Albany, OR (US); Scott A. Linn, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/748,285

(22) PCT Filed: Oct. 30, 2015

(86) PCT No.: PCT/US2015/058406

§ 371 (c)(1),
(2) Date: Jan. 29, 2018

(87) PCT Pub. No.: WO2017/074443

PCT Pub. Date: May 4, 2017

(65) Prior Publication Data

US 2018/0215150 A1 Aug. 2, 2018

(51) Int. Cl.
*B41J 2/14* (2006.01)
*B41J 2/175* (2006.01)

(52) U.S. Cl.
CPC ..... *B41J 2/14056* (2013.01); *B41J 2/1404* (2013.01); *B41J 2/175* (2013.01);
(Continued)

(58) Field of Classification Search
CPC .. B41J 2/14024; B41J 2/14233; B41J 2/1404; B41J 2002/14403; B41J 2002/14467; B41J 2202/12
(Continued)

(56) References Cited

U.S. PATENT DOCUMENTS 6,017,117 A * 1/2000 McClelland ..... B41J 2/14072 347/84
7,455,377 B2 11/2008 Espasa et al.
(Continued)

FOREIGN PATENT DOCUMENTS

WO WO-2012057758 5/2012
WO WO-2014003772 A1 1/2014
(Continued)

OTHER PUBLICATIONS

Shin et al., "Firing Frequency Improvement of Back Shooting Inkjet Printhead by Thermal Management," The 12th International Conference on Solid State Sensors, Actuators and Microsystems, Boston, Jun. 8-12, 2003, pp. 380-383.

*Primary Examiner* — An H Do
(74) *Attorney, Agent, or Firm* — HP Inc.—Patent Department

(57) ABSTRACT

According to an example, a printing system may include a drop ejecting element and a fluid circulating element corresponding to the drop ejecting element. The printing system may also include a logic device that is to receive a data stream addressed to the drop ejecting element, determine whether the data stream indicates that the drop ejecting element is to be energized, and in response to a determination that the data stream does not indicate that the drop ejecting element is to be energized, energize the fluid circulating element.

15 Claims, 6 Drawing Sheets

(52) U.S. Cl.
CPC .. *B41J 2/17596* (2013.01); *B41J 2002/14467* (2013.01); *B41J 2202/11* (2013.01); *B41J 2202/12* (2013.01)

(58) Field of Classification Search
USPC ..... 347/84, 85, 89
See application file for complete search history.

(56) References Cited

U.S. PATENT DOCUMENTS

| | | | |
|---|---|---|---|
| 7,775,616 | B2 | 8/2010 | Silverbrook et al. |
| 8,136,912 | B2 | 3/2012 | Nakano |
| 8,721,017 | B2 | 5/2014 | Yamaguchi et al. |
| 8,721,061 | B2 | 5/2014 | Govyadinov et al. |
| 2007/0109606 | A1 | 5/2007 | Nagae |
| 2011/0128335 | A1 | 6/2011 | von Essen et al. |
| 2013/0278688 | A1 | 10/2013 | Bibl |
| 2014/0204148 | A1 | 7/2014 | Ge et al. |

FOREIGN PATENT DOCUMENTS

| | | | |
|---|---|---|---|
| WO | WO-2014084843 | A1 | 6/2014 |
| WO | WO-2016068988 | | 5/2016 |

* cited by examiner

PRINTING SYSTEM WITH A FLUID CIRCULATING ELEMENT

CROSS-REFERENCE TO RELATED APPLICATION

The present application is the U.S. National Stage under 35 U.S.C. § 371 of International Patent Application No. PCT/US2015/058406, filed Oct. 30, 2015, the disclosure of which is hereby incorporated herein by reference.

BACKGROUND

Fluid ejection devices, such as printheads or dies in inkjet printing systems, typically use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other. It is typically undesirable to hold ink within the fluidic chambers for prolonged periods of time without either firing or recirculating because the water or other fluid in the ink may evaporate. In addition, when pigment-based inks are held in the fluidic chambers for prolonged periods of time, the pigment may separate from the fluid vehicle in which the pigment is mixed. These issues may result in altered drop trajectories, velocities, shapes and colors, all of which can negatively impact the print quality of a printed image.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
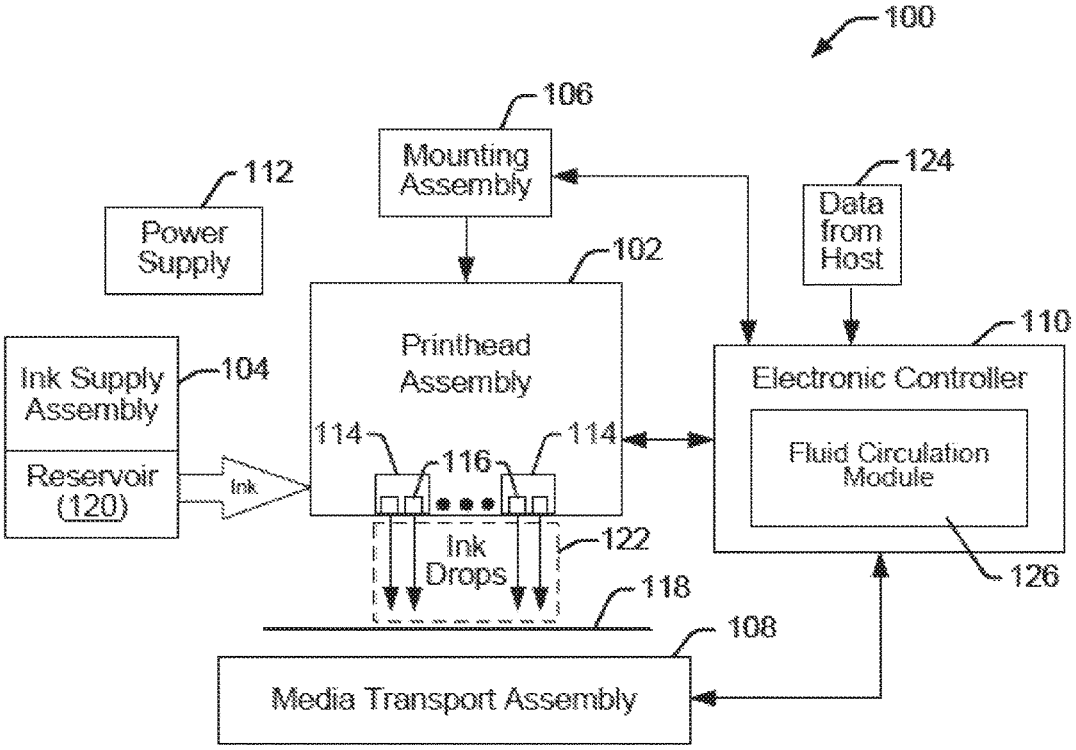
FIG. 1 depicts a simplified block diagram of an inkjet printing system, according to an example of the present disclosure.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Additionally, It should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein are printing systems and methods for controlling operation of the printing systems. Generally speaking, the printing systems and methods disclosed herein are directed to data driven recirculation of fluid in a fluid ejection device having a drop ejecting element and fluid circulating element, in which the fluid circulating element is in fluid communication with the drop ejecting element via a fluid circulation channel. More particularly, the printing systems may include a logic device that may be integrated into a fluid ejection assembly (or printhead) and is to receive an instruction data stream addressed to the drop ejecting element. The logic device may determine whether the instruction data stream includes an indication as to whether the drop ejecting element is to be energized. In response to a determination that the instruction data stream includes an indication that the drop ejecting element is to be energized, the logic device may energize the drop ejecting element. However, in response to a determination that the instruction data stream does not include an indication that the drop ejecting element is to be energized, the logic device may energize the fluid circulating element. In this regard, the logic device may energize the fluid circulating element without receiving a direct instruction to do so. Recirculation of the fluid through the fluid ejection device may therefore be data driven.

As discussed in greater detail herein below, energization of the fluid circulating element is intended to result in the circulation of fluid through a firing chamber, to thus keep the fluid in the firing chamber fresh, i.e., maintain desired fluid properties. In addition, in instances in which the fluid circulating element is a thermal resistor, energization of the fluid circulating element may also result in a warming of the fluid. In one regard, therefore, through implementation of the printing systems and methods disclosed herein, the fluid may be warmed through activation or energization of the fluid circulating element, in which a separate instruction to activate the fluid circulating element may not be needed. Instead, the logic device may activate the fluid circulating element when the logic device receives an instruction data stream that is addressed to the drop ejecting element but does not contain an instruction for the drop ejecting element to be energized, i.e., does not contain data for the drop ejecting element. In this regard, the amount of bandwidth required to enable warming by activating the fluid circulating element may be significantly lower than is needed to separately instruct the fluid circulating element to be energized for purposes of recirculation and/or warming. Moreover, and as discussed in greater detail herein below, activation of the fluid circulating element may further be controlled based upon various settings and conditions of the printing system and thus may not always be activated when the instruction data stream includes an instruction addressed to a drop ejecting element but contains no data.

With reference first to FIG. 1, there is shown a simplified block diagram of an inkjet printing system 100 having a printhead in which a fluid may be recirculated through the firing chamber of the printhead, according to an example. The inkjet printing system 100 is depicted as including a printhead assembly 102, an ink supply assembly 104, a mounting assembly 106, a media transport assembly 108, an electronic controller 110, and a power supply 112 that provides power to the various electrical components of the inkjet printing system 100. The printhead assembly 102 is also depicted as including a fluid ejection assembly 114 (or, equivalently, printheads 114) that ejects drops of ink through a plurality of orifices or nozzles 116 toward a print media 118 so as to print on the print media 118.

The print media 118 may be any type of suitable sheet or roll material, such as paper, card stock, transparencies, Mylar, and the like. The nozzles 116 may be arranged in one or more columns or arrays such that properly sequenced ejection of ink from the nozzles 116 causes characters, symbols, and/or other graphics or images to be printed on print media 118 as the printhead assembly 102 and print media 118 are moved relative to each other.

The ink supply assembly 104 may supply fluid ink to the printhead assembly 102 and, in one example, includes a reservoir 120 for storing ink such that ink flows from the reservoir 120 to the printhead assembly 102. The ink supply assembly 104 and the printhead assembly 102 may form a one-way ink delivery system or a recirculating ink delivery system. In a one-way ink delivery system, substantially all of the ink supplied to the printhead assembly 102 is consumed during printing. In a recirculating ink delivery system, only a portion of the ink supplied to printhead assembly 102 is consumed during printing and ink that is not consumed during printing may be returned to the ink supply assembly 104.

In one example, the printhead assembly 102 and the ink supply assembly 104 are housed together in an inkjet cartridge or pen. In another example, the ink supply assembly 104 is separate from printhead assembly 102 and supplies ink to the printhead assembly 102 through an interface connection, such as a supply tube. In either example, the reservoir 120 of ink supply assembly 104 may be removed, replaced, and/or refilled. Where the printhead assembly 102 and the ink supply assembly 104 are housed together in an inkjet cartridge, the reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

The mounting assembly 106 is to position the printhead assembly 102 relative to the media transport assembly 108, and the media transport assembly 108 is to position the print media 118 relative to the printhead assembly 102. Thus, a print zone 122 may be defined adjacent to the nozzles 116 in an area between the printhead assembly 102 and the print media 118. In one example, the printhead assembly 102 is a scanning type printhead assembly. In this example, the mounting assembly 106 includes a carriage for moving the printhead assembly 102 relative to the media transport assembly 108 to scan across the print media 118. In another example, the printhead assembly 102 is a non-scanning type printhead assembly. In this example, the mounting assembly 106 fixes the printhead assembly 102 at a prescribed position relative to the media transport assembly 108. Thus, the media transport assembly 108 may position the print media 118 relative to the printhead assembly 102.

The electronic controller 110 may include a processor, firmware, software, one or more memory components including volatile and non-volatile memory components, and other printer electronics for communicating with and controlling the printhead assembly 102, the mounting assembly 106, and the media transport assembly 108. The electronic controller 110 may receive data 124 from a host system, such as a computer, and may temporarily store the data 124 in a memory (not shown). The data 124 may be sent to the inkjet printing system 100 along an electronic, infrared, optical, or other information transfer path. The data 124 may represent, for example, a document and/or file to be printed. As such, the data 124 may form a print job for the inkjet printing system 100 and may include one or more print job commands and/or command parameters.

In one example, the electronic controller 110 controls the printhead assembly 102 for ejection of ink drops from the nozzles 116. Thus, the electronic controller 110 may define a pattern of ejected ink drops which form characters, symbols, and/or other graphics or images on the print media 118. The pattern of ejected ink drops may be determined by the print job commands and/or command parameters.

The printhead assembly 102 may include a plurality of printheads 114. In one example, the printhead assembly 102 is a wide-array or multi-head printhead assembly. In one implementation of a wide-array assembly, the printhead assembly 102 includes a carrier that carries the plurality of printheads 114, provides electrical communication between the printheads 114 and the electronic controller 110, and provides fluidic communication between the printheads 114 and the ink supply assembly 104.

In one example, the inkjet printing system 100 is a drop-on-demand thermal inkjet printing system in which the printhead 114 is a thermal inkjet (TIJ) printhead. The thermal inkjet printhead may implement a thermal resistor ejection element in an ink chamber to vaporize ink and create bubbles that force ink or other fluid drops out of the nozzles 116. In another example, the inkjet printing system 100 is a drop-on-demand piezoelectric inkjet printing system in which the printhead 114 is a piezoelectric inkjet (PIJ) printhead that implements a piezoelectric material actuator as an ejection element to generate pressure pulses that force ink drops out of the nozzles 116.

According to an example, the electronic controller 110 includes a flow circulation module 126 stored in a memory of the electronic controller 110. The flow circulation module 126 may be a set of instructions and may execute on the electronic controller 110 (i.e., a processor of the electronic controller 110) to control the operation of one or more fluid actuators integrated as pump elements within the printhead assembly 102 to control circulation of fluid within the printhead assembly 102, as described in greater detail herein below.

Figure 2B:
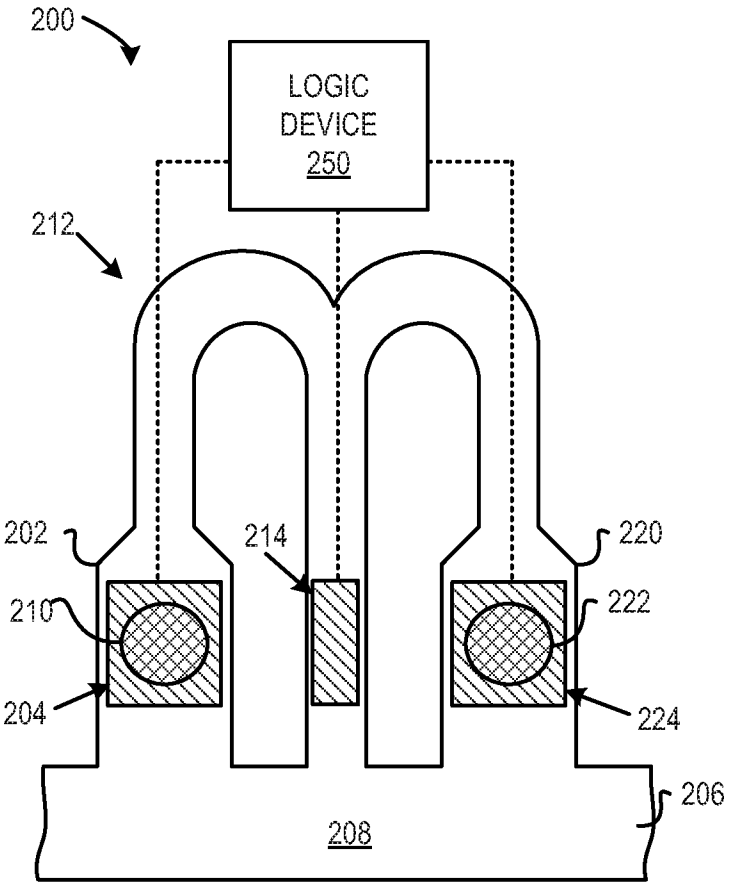
FIGS. 2A and 2B, respectively, show schematic plan views of a portion of a fluid ejection device, according to examples of the present disclosure.
Figure 2A:
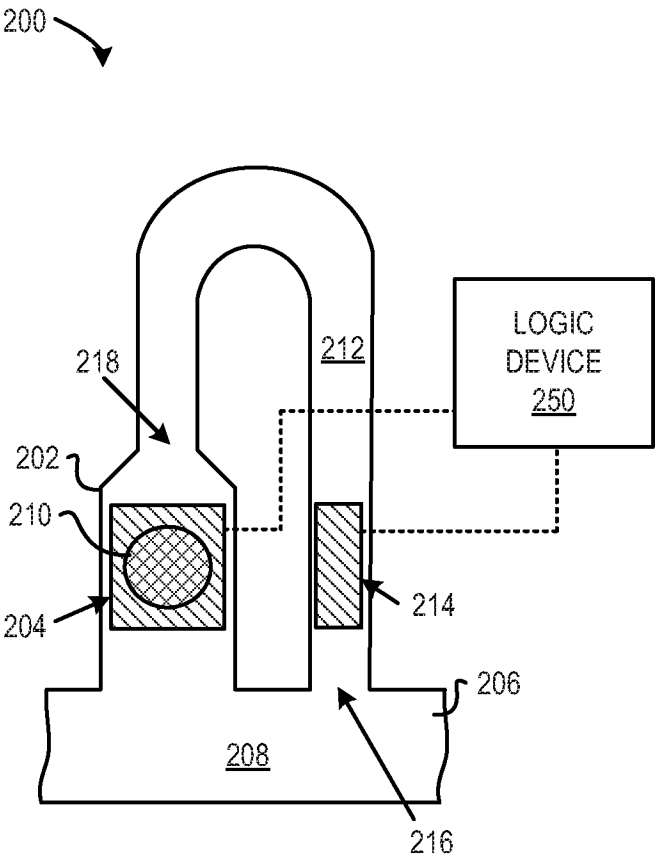

With reference now to FIG. 2A, there is shown a schematic plan view of a portion of a fluid ejection device 200, according to an example. As shown in FIG. 2A, the fluid ejection device 200 may include a fluid ejection chamber 202 and a corresponding drop ejecting element 204 formed in, provided within, or communicated with the fluid ejection chamber 202. The fluid ejection chamber 202 and the drop ejecting element 204 may be formed on a substrate 206, which has a fluid (or ink) feed slot 208 formed therein such that the fluid feed slot 208 provides a supply of fluid (or ink) to the fluid ejection chamber 205 and the drop ejecting element 204. The substrate 208 may be formed, for example, of silicon, glass, a stable polymer, or the like. According to an example, a plurality of portions similar to the portion depicted in FIG. 2A may be provided along the substrate 206.

In one example, the fluid ejection chamber 202 is formed in or defined by a barrier layer (not shown) provided on the substrate 206, such that the fluid ejection chamber 202 provides a "well" in the barrier layer. The barrier layer may be formed, for example, of a photoimageable epoxy resin, such as SU8.

According to an example, a nozzle or orifice layer (not shown) is formed or extended over the barrier layer such that a nozzle opening or orifice 210 formed in the orifice layer communicates with the fluid ejection chamber 202. The nozzle opening or orifice 210 may be of a circular, non-circular, or other shape.

The drop ejecting element 204 may be any device that is to eject fluid drops through the nozzle opening or orifice 210. Examples of suitable drop ejecting elements 210 include thermal resistors and piezoelectric actuators. A thermal resistor, as an example of a drop ejecting element, may be formed on a surface of a substrate (substrate 206), and may include a thin-film stack including an oxide layer, a metal layer, and a passivation layer such that, when activated, heat from the thermal resistor vaporizes fluid in a fluid ejection chamber 202, thereby causing a bubble that ejects a drop of fluid through the nozzle opening or orifice 210. A piezoelectric actuator, as an example of a drop ejecting element, may include a piezoelectric material provided on a moveable membrane communicated with a fluid ejection chamber 202 such that, when activated, the piezoelectric material causes deflection of the membrane relative to the fluid ejection chamber 202, thereby generating a pressure pulse that ejects a drop of fluid through the nozzle opening or orifice 210.

As illustrated in FIG. 2A, the fluid ejection device 200 includes a fluid circulation channel 212 and a fluid circulating element 214 formed in, provided within, or communicated with the fluid circulation channel 212. The fluid circulation channel 212 includes a section that is open to and in fluid communication at one end 216 (or first end 216) with the fluid feed slot 208. The channel section is also open to and in fluid communication at an opposite end 218 to the fluid ejection chamber 202. As shown in FIG. 2A, the fluid circulation channel 212 may form a U-shaped channel.

The fluid circulating element 214 may form or represent an actuator to pump or circulate (or recirculate) fluid through the fluid circulation channel 212. The fluid circulating element 214 may thus be a thermal resistor or a piezoelectric actuator. In one regard, fluid from the fluid feed slot 208 may circulate (or recirculate) through the fluid circulation channel 218 and through the fluid ejection chamber 202 based on flow induced by the fluid circulating element 214. As such, fluid may circulate (or recirculate) between the fluid feed slot 208 and the fluid ejection chamber 202 through the fluid circulation channel 218. Circulating (or recirculating) fluid through the fluid ejection chamber 202 may help to reduce ink blockage and/or clogging in the fluid ejection device 200 as well as to keep the fluid in the fluid ejection chamber 202 fresh, i.e., reduce or minimize pigment separation, water evaporation, etc.

Also illustrated in FIG. 2A is a logic device 250. The logic device 250 may selectively energize the drop ejecting element 204 and the fluid circulating element 214 based upon receipt of control signals. The logic device 250 may be integrated into a fluid ejection assembly 114 (or printhead 114) on which the fluid ejection device 200 is provided. That is, for instance, the logic device 250 may include a programmable logic chip or circuit that is integrated into the fluid ejection assembly 114 and is programmed to operate in the manners described below. By way of example, the logic device 250 may be a device on the fluid ejection assembly 114 that is to control energization of the field effect transistors (FETs) that control firing of the drop ejecting elements 204 and the fluid circulating element 214 in the fluid ejection devices 200 of the fluid ejection assembly 114. In another example, the logic device 250 may be equivalent to the electronic controller 110 depicted in FIG. 1 and may thus include instructions stored in a memory that the electronic controller 110 may execute to perform the operations of the logic device 250 described herein. Various manners in which the logic device may operate are described in greater detail herein below.

As illustrated in FIG. 2A, the fluid ejection device 200 is depicted as including one fluid ejection chamber 202 with one nozzle 210 and one fluid circulating element 214. In this regard, the fluid ejection device 200 is depicted as having a 1:1 nozzle-to-pump ratio, in which the fluid circulating element 214 is referred to as a "pump" that induces fluid flow through the fluid circulation channel 212. With a 1:1 ratio, circulation is provided for the fluid ejection chamber 202 by the single fluid circulating element 214. Other nozzle-to-pump ratios (e.g., 2:1, 3:1, 4:1, etc.) are also possible, where one fluid circulating element 214 induces fluid flow through a fluid circulation channel communicated with multiple fluid ejection chambers and, therefore, multiple nozzle openings or orifices.

An example of a fluid ejection device 200 having a 2:1 nozzle-to-pump ratio is shown in FIG. 2B. As shown in FIG. 2B, in addition to the components of the fluid ejection device 200 depicted in FIG. 2A, the fluid ejection device 200 may also include a second fluid ejection chamber 220, a second nozzle or orifice 222, and a second drop ejecting element 224. In addition, the fluid circulation channel 212 is depicted as having multiple U-shaped sections that are in fluid communication with both of the fluid ejection chambers 202, 220. With a 2:1 ratio, circulation is provided for each of the fluid ejection chambers 202, 220 by a single fluid circulating element 214 in the fluid circulation channel 212. In a further example, the fluid circulating element 214 and may instead be positioned on one side of both of the fluid ejection chambers 202, 220.

In the examples illustrated in FIGS. 2A and 2B, the drop ejecting elements 204 and 224 and the fluid circulating element 214 may be thermal resistors. Each of the thermal resistors may include, for example, a single resistor, a split resistor, a comb resistor, or multiple resistors. A variety of other devices, however, may also be used to implement the drop ejecting elements 204, 224 and the fluid circulating element 214 including, for example, a piezoelectric actuator, an electrostatic (MEMS) membrane, a mechanical/impact driven membrane, a voice coil, a magneto-strictive drive, and so on.

Figure 3:
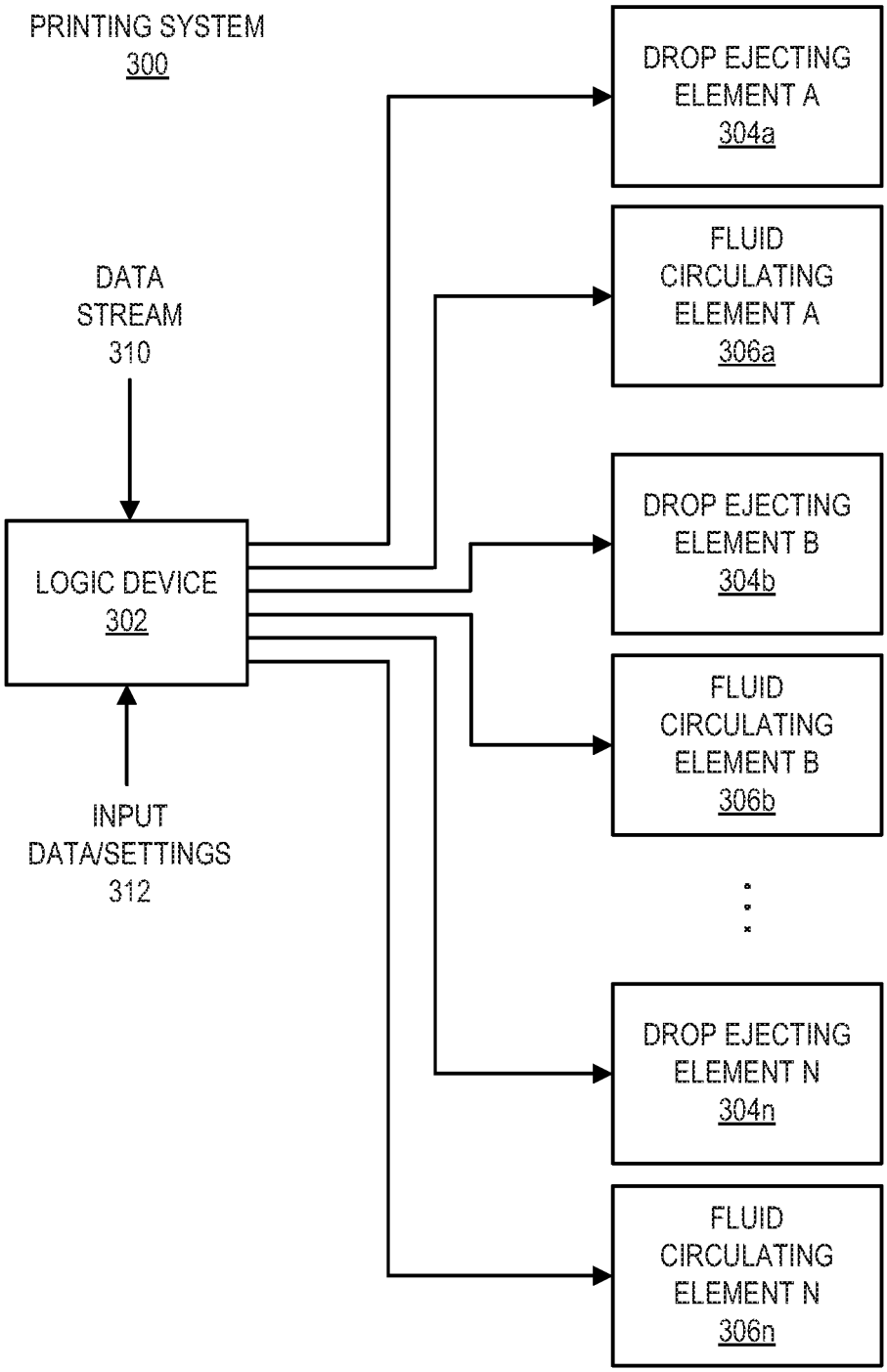
FIG. 3 shows a block diagram of a portion of a printing system, according to an example of the present disclosure.

With reference now to FIG. 3, there is shown a block diagram of a portion of a printing system 300, according to an example of the present disclosure. The printing system 300 is depicted as having a logic device 302 that is in electrical communication with each of a plurality of drop ejecting elements 304*a*-304*n* and a plurality of fluid circulating elements 306*a*-306*n*. As discussed above, the logic device 302 may be provided in a fluid ejection assembly 114 containing fluid ejection devices 200 that contain the drop ejecting elements 304*a*-304*n* and the fluid circulating elements 306*a*-306*n*. The printing system 300 may thus represent a fluid ejection assembly 114 (or equivalently, a printhead 114). In FIG. 3, the variable "n" denotes an integer value that is greater than 1. In addition, each of the drop ejecting elements 304*a*-304*n* is associated with a corresponding fluid circulating element 306*a*-306*n*. In other words, a first drop ejecting element 304*a* is in fluidic communication with a first fluid circulating element 306*a* through a first fluid circulation channel (e.g., fluid circulation channel 212 (FIG. 2A)), a second drop ejecting element 304*b* is in fluidic communication with a second fluid circulating element 306*b* through a second fluid circulation channel, and so forth. In other examples, however, multiple ones of the drop ejecting elements 304*a*-304*n* may be associated with individual ones of the fluid circulating elements 306*a*-306*n*, for instance, in an N:1 nozzle-to-pump ratio as described above with respect to FIG. 2B.

Each of the drop ejecting elements 304*a*-304*n* and the fluid circulating elements 306*a*-306*n* may be assigned a respective address. As such, an instruction data stream 310 may include an address of one of the drop ejecting elements 304*a*-304*n* or the fluid circulating elements 306*a*-306*n*. In addition, the logic device 302 may send a firing signal, e.g., energize, a particular one of the drop ejecting elements 304*a*-304*n* or the fluid circulating elements 306*a*-306*n* based upon the address identified in a received data stream 310. Although individual drop ejecting elements 304*a*-304*n* and fluid circulating elements 306*a*-306*n* are depicted in FIG. 3, it should be understood that the logic device 302 may instead sending firing signals, e.g., energize, other components that are in communication with the drop ejecting elements 304*a*-304*n* and the fluid circulating elements 306*a*-306*n*. For instance, each of the drop ejecting elements 304*a*-304*n* and the fluid circulating elements 306*a*-306*n* may be controlled by a respective corresponding field effect transistor (FET) (not shown), and the logic device 302 may send a firing signal to the corresponding FET of a selected drop ejecting element 304*a*-304*n* or fluid circulating element 306*a*-306*n* to cause that element to be energized.

The drop ejecting elements 304*a*-304*n* and the fluid circulating elements 306*a*-306*n* may be organized into groups referred to as primitives. Each primitive may include a group of adjacent drop ejecting elements 304*a*-304*n* and their corresponding fluid circulating elements 306*a*-306*n*. A primitive may include any reasonably suitable number of drop ejecting elements 304*a*-304*n* and their corresponding fluid circulating elements 306*a*-306*n*, for instance, groups of six, eight, ten, twelve, fourteen, sixteen, and so on. By way of example, during a printing cycle, the logic device 302 may send a firing signal to one address in a primitive at a time.

In a particular example, the logic device 302 may receive an instruction data stream 310 that includes an address of a drop ejecting element 304*a*. The logic device 302 may receive the data stream 310, for instance, as data from a host 124 (FIG. 1). In any regard, the logic device 302 may determine whether the data stream 310 indicates that the drop ejecting element 304*a* is to eject a droplet of fluid. In other words, the logic device 302 may determine whether the drop ejecting element 304*a* is to be fired. In response to a determination that the drop ejecting element 304*a* is to eject a droplet of fluid, the logic device 302 may send a signal, e.g., energize, the drop ejecting element 304*a*. According to an example, the logic device 302 may determine that the data stream 310 indicates that the drop ejecting element 304*a* is to eject a droplet of fluid in response a determination that the data stream 310 contains data, e.g., a bit, that indicates this feature.

However, and according to an example, in response to a determination that the data stream 310 does not indicate that the drop ejecting element 304*a* is to eject a droplet of fluid, the logic device 302 may send a signal, e.g., energize, the fluid circulating element 306*a* corresponding to the drop ejecting element 304*a*. The logic device 302 may thus energize the fluid circulating element 306*a* even though the data stream 310 did not include an instruction to energize the fluid circulating element 306*a*. As such, instead of requiring a separate signal to energize the fluid circulating element 306*a*, the logic device 302 may use the signal intended for the drop ejecting element 304*a* to energize the fluid circulating element 306*a*. In one regard, through implementation of this feature, the bandwidth required to activate the fluid circulating element 306*a* may be significantly reduced as compared with requiring that the logic device 302 require receipt of a separate signal to activate the fluid circulating element 306*a*.

As discussed above, activation or energization of the fluid circulating element 306*a* may cause the fluid contained in the fluid ejection chamber 202 and the fluid circulation channel 212 to be circulated or recirculated without causing fluid in the fluid ejection chamber 202 from being ejected through a nozzle 210. Thus, in one regard, by energizing the fluid circulating element 306*a* when the corresponding drop ejecting element 304*a* is not energized, the fluid in the fluid ejection chamber 202 may be recirculated, which may keep that fluid fresh. In addition, in instances in which the fluid circulating elements 306*a*-306*n* are thermal resistors, energization of the fluid circulating elements 306*a*-306*n* may heat the fluid in the fluid circulation channel 212 as well as surrounding areas of the fluid circulating elements 306*a*-306*n*. Thus, in another regard, by energizing the fluid circulating elements 306*a*-306*n* when the corresponding drop ejecting elements 304*a*-304*n* are not energized, heat may still be applied to the fluid in the fluid circulation channels 212 and the fluid ejection chambers 202 to, for instance, maintain their temperatures above predetermined levels, which may improve nozzle performance.

As also shown in FIG. 3, the logic device 302 may receive input data/settings 312. The input data/settings 312 may include various data and/or settings, such as whether a primary warming mode is active, whether a recirculation warming mode is active, whether a temperature of a primitive is above or below a predetermined threshold temperature, etc. As described in greater detail herein below, the logic device 302 may not always energize a fluid circulating element 306*a* in response to a determination that a data stream 310 is addressed to the drop ejecting element 304*a* corresponding to that fluid circulating element 306*a* but does not contain an instruction for the drop ejecting element 304*a* to eject a droplet of fluid. Instead, the logic device 302 may use the input data/settings 312 in determining whether to energize a fluid circulating element 306*a* in these instances.

Figure 4:
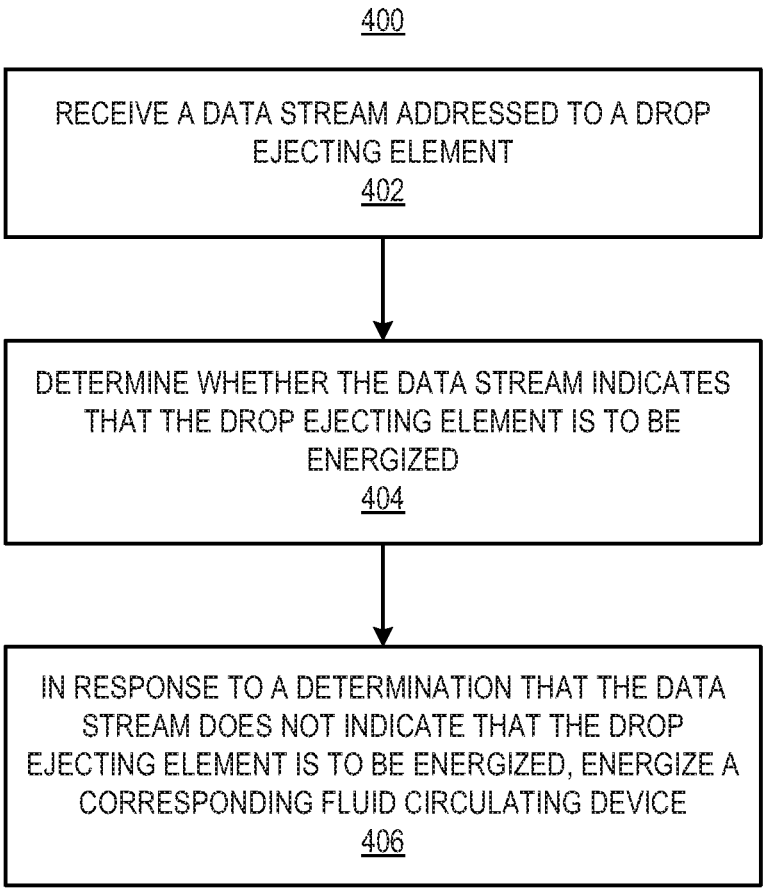
FIGS. 4 and 5, respectively, show flow diagrams of methods and for controlling a fluid circulating element, according to two examples of the present disclosure.
Figure 5:
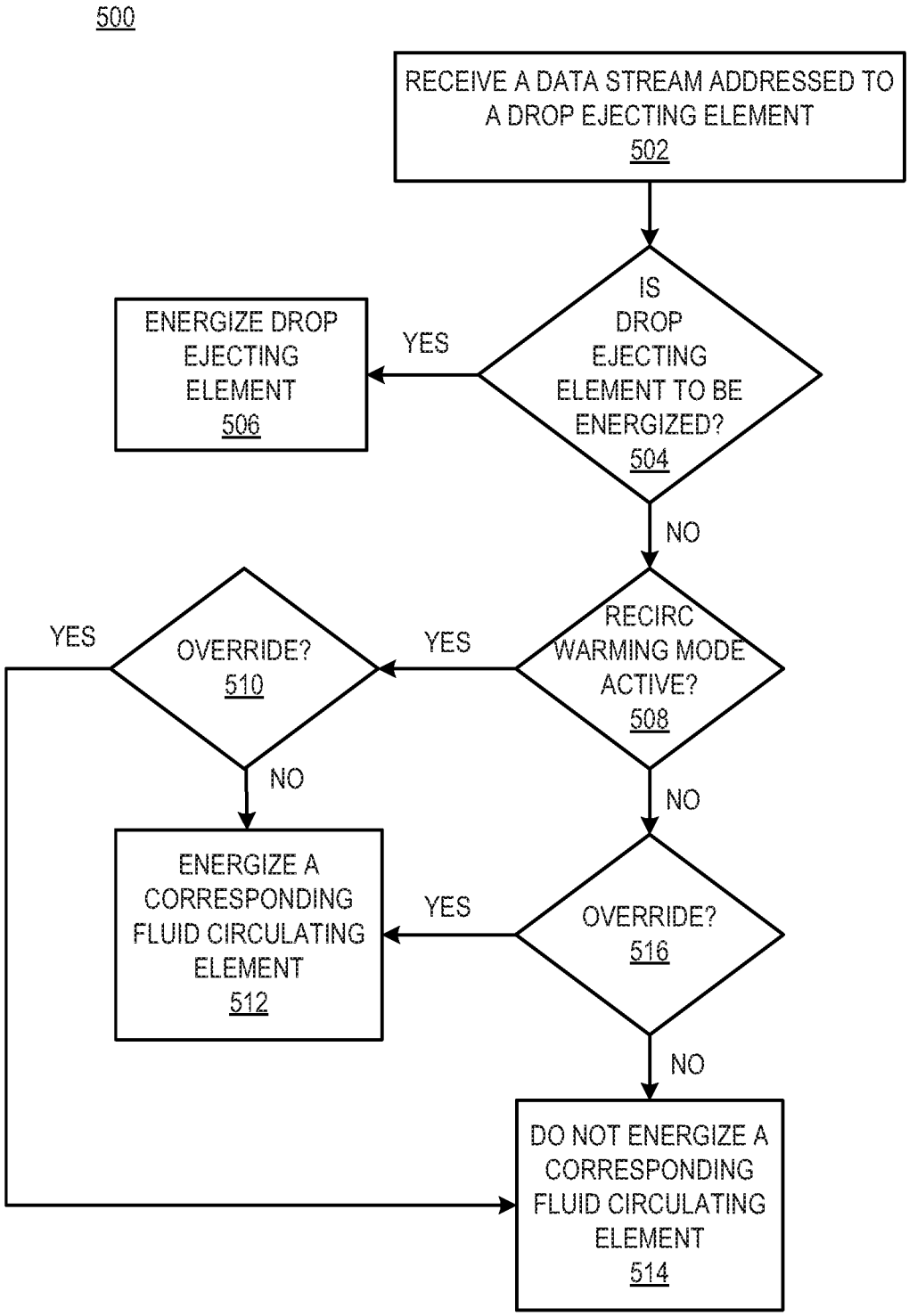

With reference now to FIGS. 4 and 5, there are respectively shown flow diagrams of methods 400 and 500 for controlling a printing system, according to two examples. The method 500 is related to the method 400 in that the method 500 provides additional detail with respect to the features recited in the method 400. It should be understood that the methods 400 and 500 depicted in FIGS. 4 and 5 may include additional operations and that some of the operations described therein may be removed and/or modified without departing from the scopes of the methods 400 and 500. Additionally, it should be understood that the order in which some of the operations in the methods 400 and 500 are implemented may be switched.

The descriptions of the methods 400 and 500 are made with reference to the features depicted in FIGS. 2A and 3 for purposes of illustration and thus, it should be understood that the methods 400 and 500 may be implemented in printing systems having other configurations. In addition, particular reference is made to a first drop ejecting element 304*a* and a first fluid circulating element 306*a* that corresponds to the first drop ejecting element 304*a*. It should, however, be understood that the features recited herein with respect to those elements are also applicable to the remaining elements 304*b*-304*n*, 306*b*-306*n*.

At block 402, a logic device 302 may receive a data stream 310 addressed to a drop ejecting element 304*a* of a fluid ejection device 200. As discussed above, the fluid ejection device 200 may have a fluid circulating element 306*a* (shown as element 214 in FIG. 2) in fluid communication with a fluid ejection chamber 202 housing the drop ejecting element 304*a* (shown as element 204 in FIG. 4). In addition, the drop ejecting element 304*a* and the fluid circulating element 214 are independently addressable with respect to each other. At block 402, the logic device 302 may receive the data stream 310 from a host or other source and the logic device 302 may interpret the data stream 310 as an instruction to either energize or not energize the drop ejecting element 304*a*.

At block 404, the logic device 302 may determine whether the data stream 310 indicates that the drop ejecting element 304*a* is to eject a droplet of fluid. For instance, the data stream 310 may include a bit or bits that identify the address of the drop ejecting element 304*a* and a data bit, in which the data bit may be set to 1 if the drop ejecting element 304*a* is to be energized and to 0 if the drop ejecting element 304*a* is not to be energized. Alternatively, the data bit may be set to 0 if the drop ejecting element 304*a* is to be energized and to 1 if the drop ejecting element 304*a* is not to be energized.

At block 406, in response to a determination that the data stream 310 does not indicate that the drop ejecting element 304*a* is to be energized, the logic device 302 may energize the fluid circulating element 306*a* corresponding to the drop ejecting element 304*a*. As discussed above, energizing the fluid circulating element 306*a* in this manner may reduce the amount of bandwidth required in a printing system 300 to recirculate fluid and/or heat fluid in a fluid ejection device 200.

Turning now to FIG. 5, at block 502, a logic device 302 may receive a data stream 310 addressed to a drop ejecting element 304*a* of a fluid ejection device 200. Block 502 may be similar to block 402 in FIG. 4.

At block 504, the logic device 302 may determine whether the data stream 310 indicates that the drop ejecting element 304*a* is to be energized, e.g., eject a droplet of fluid. Block 504 may be similar to block 404 in FIG. 4. However, as indicated at block 506, in response to a determination that the drop ejecting element 304*a* is to be energized, the logic device 302 may energize the drop ejecting element 304*a* to thus cause a droplet of fluid to be expelled through a nozzle of the firing chamber in which the drop ejecting element 304*a* is positioned.

At block 508, in response to a determination that the drop ejecting element 304*a* is not to be energized, the logic device 302 may determine whether a recirculation warming mode of the primitive in which the drop ejecting element 304*a* forms part is active. That is, for instance, the data input/settings 312 may indicate whether the logic device 302 is to implement warming of a primitive (or a portion of a die, the entire die, etc.) through energization of the fluid circulation elements 306*a*-306*n*. The recirculation warming mode may be set manually or automatically. When set manually, a user may input a setting to the logic device 302 as to whether the recirculation warming mode is active. In an automatic setting, a temperature sensor may be provided in or on the fluid ejection device 200 and the recirculation warming mode may be activated, for instance, when the temperature detected by the temperature sensor falls below a predetermined temperature level. Likewise, the recirculation warming mode may not be activated, for instance, when the temperature detected by the temperature sensor exceeds the predetermined temperature level.

In response to a determination that the recirculation warming mode is active, the logic device 302 may determine whether to override the active setting of the recirculation warming mode, as indicated at block 510. That is, the logic device 302 may determine whether to energize the fluid circulation element 306*a* even though the recirculation warming mode is active (block 508) and the drop ejecting element 304*a* is not to be energized (block 504). The logic device 302 may determine that the recirculation warming mode is not to be overridden at block 510, for instance, if the logic device 302 determines that the drop ejecting element 304*a* and/or the fluid circulating element 306*a* have not been energized at least a predetermined number of times within a predetermined period of time. In other words, the logic device 302 may determine that the fluid circulating element 306*a* is to be energized if the logic device 302 determines that the temperature of the fluid in the fluid ejection device 200 containing the drop ejecting element 304*a* may be at a temperature that is below a predetermined temperature, even though a temperature sensor located elsewhere has detected a different temperature.

In any case, in response to a determination that the activation of the recirculation warming mode is not to be overridden, the logic device 302 may energize the fluid circulating element 306*a* as indicated at block 512. However, if the logic device 302 determines that the active setting of the recirculation warming mode is to be overridden, the logic device 302 may not energize the fluid circulating element 306*a*, as indicated at block 514. The logic device 302 may determine that the active setting of the recirculation warming mode is to be overridden, for instance, if the logic device 302 determines that the drop ejecting element 304*a* and/or the fluid circulating element 306*a* have been energized at least a predetermined number of times within a predetermined period of time. In other words, the logic device 302 may determine that the fluid circulating element 306*a* is not to be energized if the logic device 302 determines that the temperature of the fluid in the fluid ejection device 200 containing the drop ejecting element 304*a* may be at a temperature that is above a predetermined temperature, even though a temperature sensor located elsewhere has detected a different temperature.

In another example, however, the logic device 302 may skip block 510 and may energize the fluid circulating element 306*a* at block 512 in response to a determination that the recirculation warming mode is active at block 508.

With reference back to block 508, in response to a determination that the recirculation warming mode is not active, the logic device 302 may determine whether to override the inactive setting of the recirculation warming mode, as indicated at block 516. That is, the logic device 302 may determine whether to energize the fluid circulating element 306*a* even though the recirculation warming mode is inactive (block 508) and the drop ejecting element 304*a* is not to be energized (block 504). The logic device 302 may determine that the inactive setting of the recirculation warming mode is not to be overridden at block 516, for instance, if the logic device 302 determines that the drop ejecting element 304*a* and/or the fluid circulating element 306*a* have not been energized at least a predetermined number of times within a predetermined period of time. In other words, the logic device 302 may determine that the fluid circulating element 306*a* is to be energized if the logic device 302 determines that the temperature of the fluid in the fluid ejection device 200 containing the drop ejecting element 304*a* may be at a temperature that is below a predetermined temperature, even though the recirculation warming mode is set to be inactive.

In any case, in response to a determination that the activation of the recirculation warming mode is to be overridden at block 516, the logic device 302 may energize the fluid circulating element 306*a* as indicated at block 512. However, if the logic device 302 determines that the inactive setting of the recirculation warming mode is not to be overridden, the logic device 302 may not energize the fluid circulating element 306*a*, as indicated at block 514. The logic device 302 may determine that the inactive setting of the recirculation warming mode is not to be overridden, for instance, if the logic device 302 determines that the drop ejecting element 304*a* and/or the fluid circulating element 306*a* have been energized at least a predetermined number of times within a predetermined period of time. In other words, the logic device 302 may determine that the fluid circulating element 306*a* is not to be energized if the logic device 302 determines that the temperature of the fluid in the fluid ejection device 200 containing the drop ejecting element 304*a* may be at a temperature that is above a predetermined temperature, even though a temperature sensor located elsewhere has detected a different temperature.

In another example, however, the logic device 302 may skip block 516 and may not energize the fluid circulating element 306*a* at block 514 in response to a determination that the recirculation warming mode is inactive at block 508.

The method 500 may end for the drop ejecting element 304*a* and the fluid circulating element 306*a* following either of blocks 512 and 514. In addition, the logic device 302 may receive another data stream containing an address of another drop ejecting element 304*b* and may implement the method 500 for that drop ejecting element 304*b* and its corresponding fluid circulating element 306*b*. The logic device 302 may cycle through the addresses of each of the drop ejecting elements 304*b*-304*n* prior to addressing the drop ejecting element 304*a* or the fluid circulating element 306*a* in a subsequent print cycle. In this regard, a sufficient amount of time may be afforded to the fluid ejection device 200 containing the drop ejecting element 304*a* and the fluid circulating element 306*a* to receive a new batch of fluid from the fluid slot 208.

Some or all of the operations set forth in the methods 400 and 500 may be contained as utilities, programs, or subprograms, in any desired computer accessible medium. In addition, the methods 400 and 500 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 6:
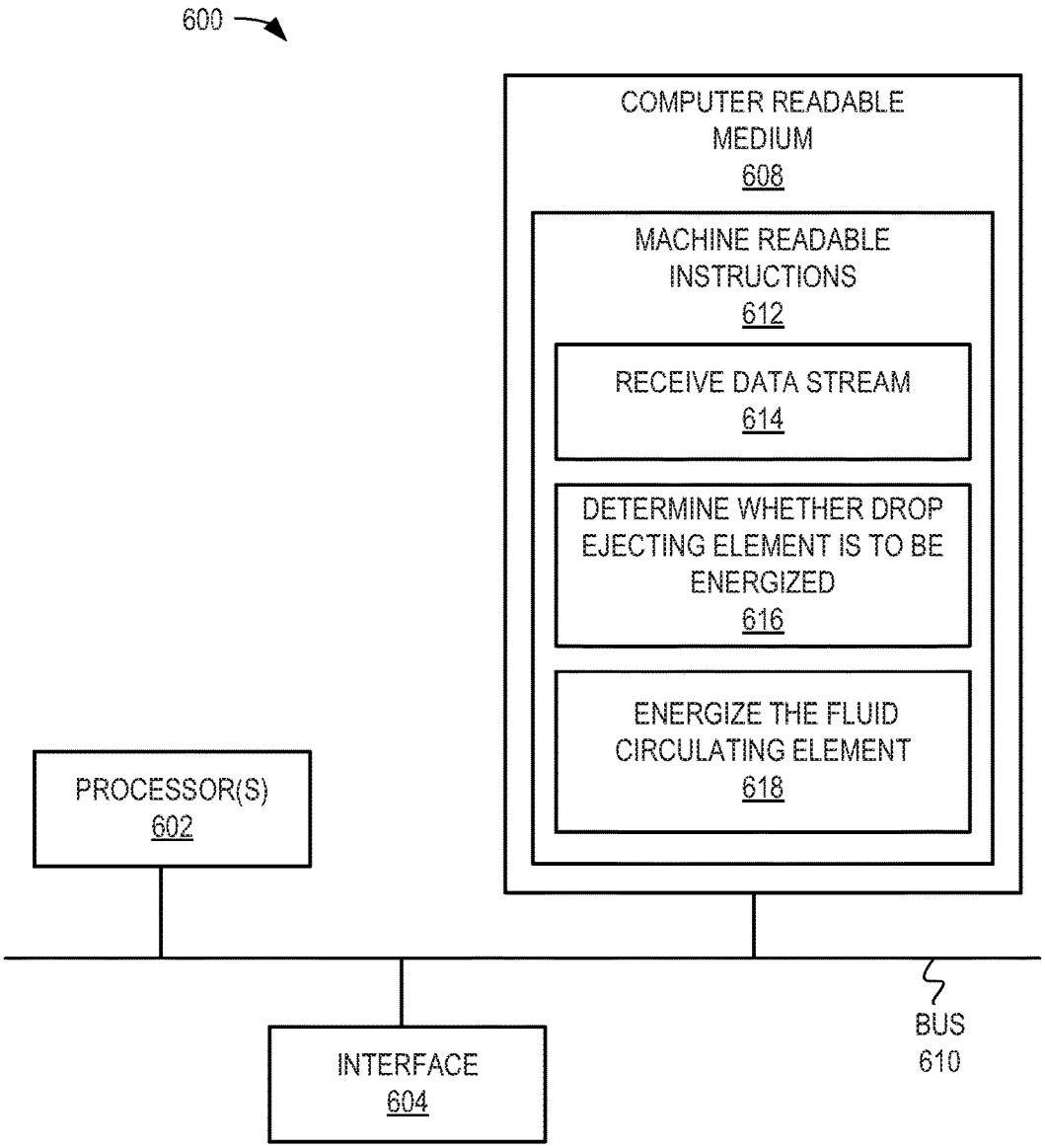
FIG. 6 shows a schematic representation of a computing device, which may be equivalent to the logic device depicted in FIG. 3, according to an example of the present disclosure.

Turning now to FIG. 6, there is shown a schematic representation of a computing device 600, which may be equivalent to the logic device 302 depicted in FIG. 3, according to an example. The computing device 600 may include a processor or processors 602; an interface 604; and a computer-readable medium 608. Each of these components may be operatively coupled to a bus 610. For example, the bus 610 may be an EISA, a PCI, a USB, a FireWire, a NuBus, or a PDS.

The computer readable medium 608 may be any suitable medium that participates in providing instructions to the processor 602 for execution. For example, the computer readable medium 608 may be non-volatile media, such as an optical or a magnetic disk; volatile media, such as memory. The computer-readable medium 608 may also store machine readable instructions 612, which, when executed by the processor 602 may cause the processor 602 to perform some or all of the methods 400 and 500 depicted in FIGS. 4 and 5. Particularly, for instance, the instructions 612 may cause the processor to receive a data stream addressed to the drop ejecting element 614, determine whether the data stream indicates that the drop ejecting element is to be energized 616; and in response to a determination that the data stream does not indicate that the drop ejecting element is to be energized, energize the fluid circulating element 618.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A printing system comprising:

a fluid ejection chamber having a nozzle;

a drop ejecting element positioned in the fluid ejection chamber to cause a droplet of fluid in the fluid ejection chamber to be ejected through the nozzle;

a fluid circulation channel in communication with the fluid ejection chamber and a fluid feed slot;

a fluid circulating element positioned in the fluid circulation channel to circulate fluid through the fluid circulation channel and the fluid ejection chamber;

a logic device to:

receive a data stream addressed to the drop ejecting element;

determine whether the data stream indicates that the drop ejecting element is to be energized; and in response to a determination that the data stream does not indicate that the drop ejecting element is to be energized, energize the fluid circulating element.

2. The printing system according to claim 1, wherein to determine whether the data stream indicates that the drop ejecting element is to be energized, the logic device is to determine whether the data stream contains data that corresponds to the indication.

3. The printing system according to claim 1, wherein the drop ejecting element and the fluid circulating element are part of a primitive, and wherein the logic device is further to:

determine whether a recirculation warming mode for the primitive is active;

in response to a determination that the data stream does not indicate that the drop ejecting element is to be energized, energize the fluid circulating element in response to an additional determination that the recirculation warming mode for the primitive is active; and not energize the fluid circulating element in response to a determination that the recirculation warming mode is not active.

4. The printing system according to claim 1, wherein the logic device is further to:

in response to a determination that the data stream indicates that the drop ejecting element is not to be energized, energize the fluid circulating element.

5. The printing system according to claim 1, wherein the drop ejecting element and the fluid circulating element are part of a primitive, and wherein the logic device is further to:

determine that a recirculation warming mode for the primitive is set to be inactive;

determine whether to override the recirculation warming mode setting; and energize the fluid circulating element in response to a determination that the recirculation warming mode setting is to be overridden.

6. The printing system according to claim 1, wherein the drop ejecting element and the fluid circulating element are part of a primitive, and wherein the logic device is further to:

determine that a recirculation warming mode for the primitive is set to be active;

determine whether to override the recirculation warming mode setting; and not energize the fluid circulating element in response to a determination that the recirculation warming mode setting is to be overridden.

7. The printing system according to claim 1, wherein the drop ejecting element and the fluid circulating element are part of a primitive, and wherein the logic device is further to:

determine that a recirculation warming mode for the primitive is set to be inactive; and not energize the fluid circulating element.

8. A method comprising:

receiving, by a logic device, a data stream addressed to a drop ejecting element of a fluid ejection device, said fluid ejection device having a fluid circulating element in fluid communication with a fluid ejection chamber housing the drop ejecting element, wherein the drop ejecting element and the fluid circulating element are independently addressable;

determining, by the logic device, whether the data stream indicates that the drop ejecting element is to be energized; and in response to a determination that the data stream does not indicate that the drop ejecting element is to be energized, energizing, by the logic device, the fluid circulating element.

9. The method according to claim 8, wherein the drop ejecting element and the fluid circulating element are part of a primitive, the method further comprising:

determining whether a recirculation warming mode for the primitive is active; and wherein energizing the fluid circulating element further comprises energizing the fluid circulating element in response to the recirculation warming mode for the primitive being active and not energizing the fluid circulating element in response to the recirculation warming mode for the primitive not being active.

10. The method according to claim 8, wherein the drop ejecting element and the fluid circulating element are part of a primitive, the method further comprising:

determining that a recirculation warming mode for the primitive is set to be inactive;

determining whether to override the recirculation warming mode setting in response to the determination that the data stream does not indicate that the drop ejecting element is to be energized; and energizing the fluid circulating element in response to a determination that the recirculation warming mode setting is to be overridden.

11. The method according to claim 8, wherein the drop ejecting element and the fluid circulating element are part of a primitive, the method further comprising:

determining that a recirculation warming mode for the primitive is set to be active;

determining whether to override the recirculation warming mode setting in response to the determination that the data stream does not indicate that the drop ejecting element is to be energized; and not energizing the fluid circulating element in response to a determination that the recirculation warming mode setting is to be overridden.

12. The method according to claim 8, wherein the drop ejecting element and the fluid circulating element are part of a primitive, wherein the primitive includes additional drop ejecting elements and corresponding fluid circulating elements, and wherein the logic device is to receive the data stream in a time slice of a print cycle for the primitive, the method further comprising:

cycling through addresses of each of the additional drop ejecting elements prior to addressing the drop ejecting element or the fluid circulating element in a subsequent print cycle.

13. A non-transitory computer readable storage medium on which is stored machine readable instructions that when executed by a processor are to cause the processor to:

receive a data stream addressed to a drop ejecting element of a fluid ejection device, said fluid ejection device having a fluid circulating element in fluid communication with a fluid ejection chamber housing the drop ejecting element, wherein the drop ejecting element and the fluid circulating element are independently addressable;

determine whether the data stream indicates that the drop ejecting element is to be energized; and in response to a determination that the data stream does not indicate that the drop ejecting element is to be energized, energize the fluid circulating element.

14. The non-transitory computer readable medium according to claim 13, wherein the drop ejecting element and the fluid circulating element are part of a primitive, and wherein the machine readable instructions are to cause the processor to:

determine whether a recirculation warming mode for the primitive is active; and wherein to energize the fluid circulating element, the machine readable instructions are to cause the processor to energize the fluid circulating element in response to the recirculation warming mode for the primitive being active and not energizing the fluid circulating element in response to the recirculation warming mode for the primitive not being active.

15. The non-transitory computer readable medium according to claim 13, wherein the drop ejecting element and the fluid circulating element are part of a primitive, and wherein the machine readable instructions are to cause the processor to:

determine whether a recirculation warming mode setting is to be overridden in response to the determination that the data stream does not indicate that the drop ejecting element is to be energized; and override the recirculation warming mode setting in response to a determination that the recirculation warming mode setting is to be overridden.

* * * * *